US005448957A

United States Patent [19]

Goldammer et al.

[11] Patent Number: 5,448,957

[45] Date of Patent: Sep. 12, 1995

[54] CYLINDER GRATE

[75] Inventors: Dieter Goldammer, Mülheim; Heinz-Peter Hasselmann, Düsseldorf, both of Germany

[73] Assignee: Deutschen Babcock Energie- und Umwelttechnik AG, Oberhausen, Germany

[21] Appl. No.: 231,105

[22] Filed: Apr. 22, 1994

[30] Foreign Application Priority Data

May 15, 1993 [DE] Germany ..... 43 16 343.2

[51] Int. Cl.[6] ..... F23H 9/02; F23H 17/00; F23G 5/20

[52] U.S. Cl. ..... 110/246; 432/115; 110/275; 110/276

[58] Field of Search ..... 432/115, 236, 246; 110/275, 276, 246

[56] References Cited

U.S. PATENT DOCUMENTS

| | | | |
|---|---|---|---|
| 4,728,289 | 3/1988 | Samera, Jr. | 432/115 |
| 4,972,786 | 11/1990 | Blasiole | 432/115 |
| 5,042,401 | 8/1991 | Ettehadieh | 110/246 |
| 5,057,011 | 10/1991 | Le Lan et al. | 110/246 |
| 5,081,939 | 1/1992 | Essen | 110/246 |
| 5,112,222 | 5/1992 | Hading et al. | 110/246 |
| 5,173,045 | 12/1992 | Macri | 432/115 |

*Primary Examiner*—Henry C. Yuen
*Assistant Examiner*—Weilun Lo
*Attorney, Agent, or Firm*—Max Fogiel

[57] ABSTRACT

A cylinder grate for incinerators, especially garbage incinerators, with hollow grate cylinders (1). The cylinders are positioned separated and axially parallel along a slanted plane (3). There is a gap between each pair of cylinders and accommodating strippers (5). The strippers are secured to stripper holders (6) below the gap. Components (11) swing back and forth below the strippers and are resiliently forced against the overall length of the cylinder.

4 Claims, 3 Drawing Sheets

CYLINDER GRATE

BACKGROUND OF THE INVENTION

The present invention concerns a cylinder grate for incinerators, especially garbage incinerators.

The mantels of the cylinders employed in such grates are composed of rods (German Patents 1 164 014 and 3 316 363). Primary incinerating air is distributed to every cylinder through separate channels. The channels communicate with ash hoppers under the grate. The air flows up and into the cylinder through the interstices between the rods at the bottom and leaves it through the interstices at the top. The material being incinerated is tossed and contacted with the incinerating air in the gaps between the cylinders. The gaps accommodate strippers that strip off any slag adhering to the rods. The strippers are rigid and can be provided with brushes (European Patent 0 157 920).

Incinerators are subject to increasing strict regulations intended for environmental protection. Such regulations concern in particular how completely the exhaust gas and solid residue burn up. To comply even more thoroughly with such strict regulations, is it necessary not only to intercept the incinerating air and control the extent of combustion section by section but also to direct the air more precisely to where it is needed. One way of doing so is to at least to some extent prevent air from leaking out.

Another is to prevent as much material as possible from dropping through the grate. The grates have until now been sealed by strippers between the cylinders. The resulting seal, however, is not very reliable because the strippers are too far from the cylinders.

SUMMARY OF THE INVENTION

The object of the present invention is accordingly an improvement in the generic cylinder grate that will prevent more air from leaking and more material from dropping through the grate.

The springs variably force the pivoting sealing components against the cylinders. A cushion of droppings accordingly forms in the airlock-like gap between the upper stripper and the sealing component. The cushion augments the seal upstream and prevents more material from dropping through. When larger masses of material from the bed of incinerating material get past the upper stripper, the individual sheets in the sealing components in one advantageous embodiment of the present invention will yield independently. The seal will accordingly be compromised only locally and not over the total width of the grate. The sealing components, which rest tight against the cylinders over their total length, and the droppings accumulating in the airlock-like gap force air between the rods and prevent it from leaking out through the surfaces of the cylinders. The advantages of the resulting tightness and associated increase in air flowing through the cylinders is better firing and regulation of combustion, low-contamination combustion, better cooling, and longer-lived grates along with minimal and more thoroughly burned droppings.

BRIEF DESCRIPTION OF THE DRAWINGS

One embodiment of the present invention will now be specified with reference to the drawing, wherein.

DESCRIPTION OF THE PREFERRED EMBODIMENTS

Figure 1:
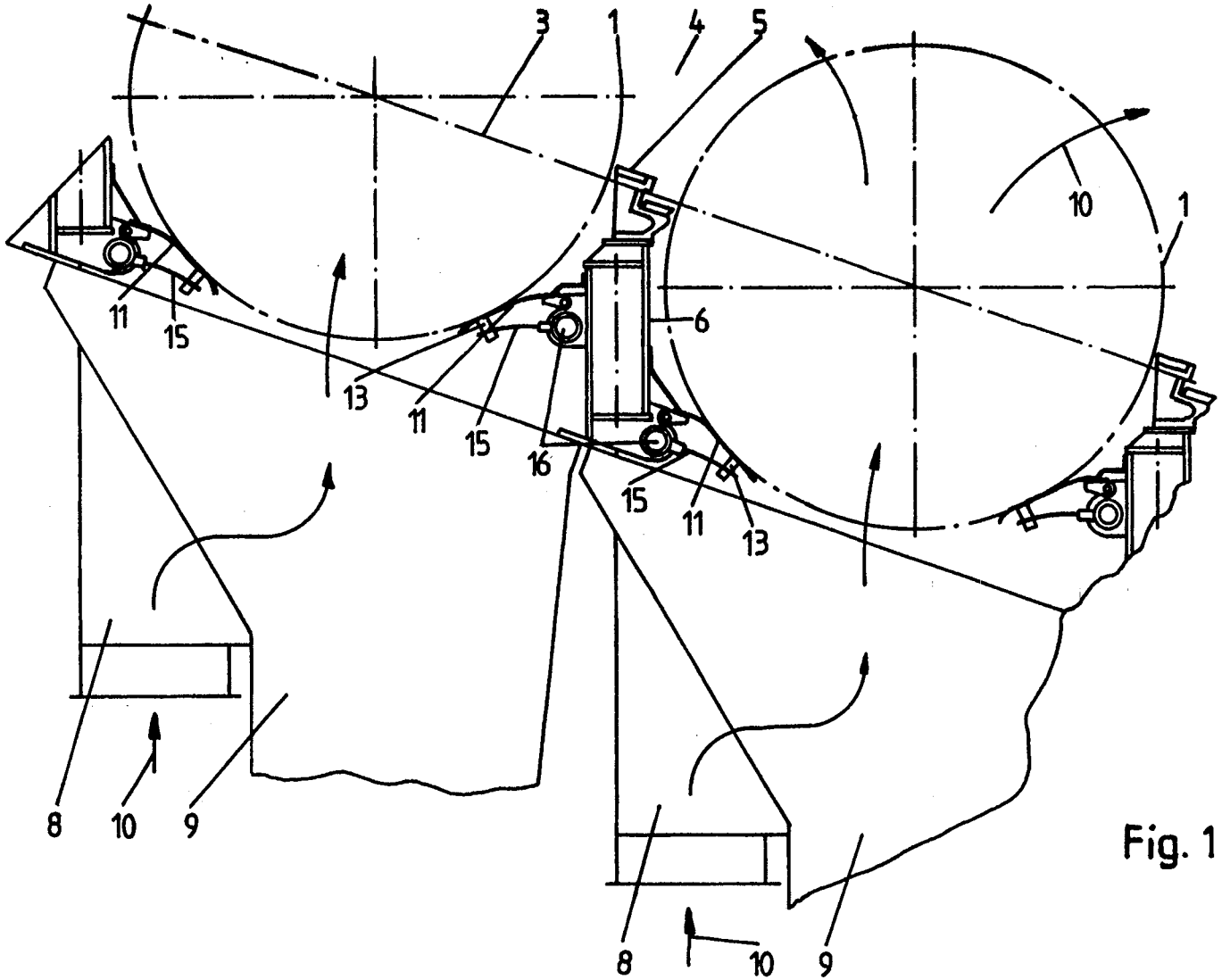
FIG. 1 illustrates part of a cylinder grate.
Figure 2:
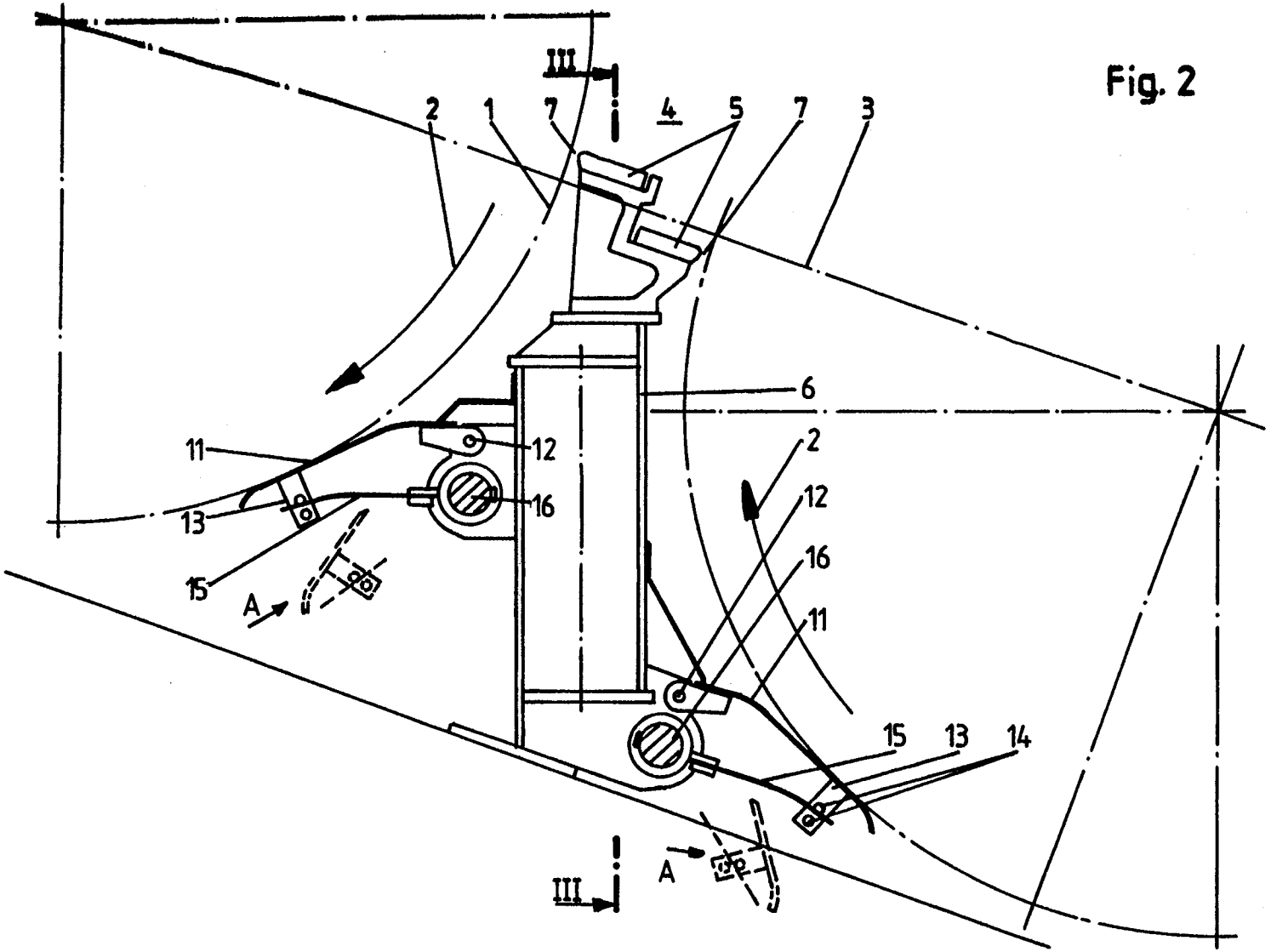
FIG. 2 is a larger-scale detail of the grate illustrated in FIG. 1.
Figure 4:
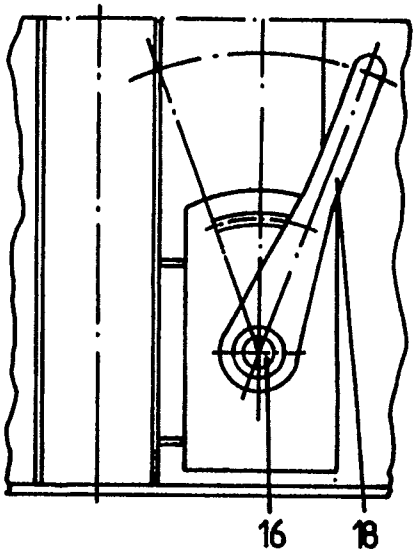
FIG. 4 is a side view of the parts illustrated in FIG. 3.
Figure 3:
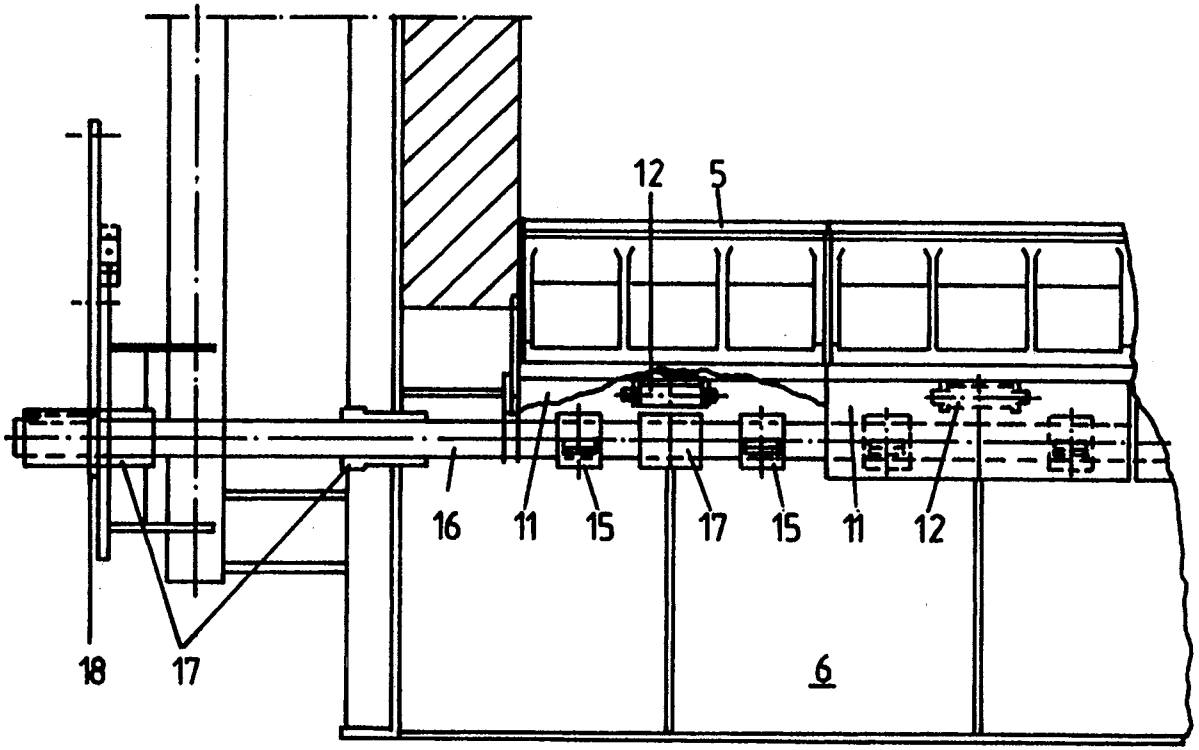
FIG. 3 is a section along the line III—III in FIG. 2.

A cylinder grate for an incinerator, especially a garbage incinerator, consists of several cylinders 1, only two of which are illustrated in FIG. 1. An unillustrated transmission rotates each cylinder 1. Adjacent cylinders rotate in opposite senses. Cylinders 1 are positioned separated and axially parallel along a slanted plane 3. Between each pair of cylinders 1 is a gap 4, into which the cylinders introduce the material being incinerated and wherein it is tossed. Gap 4 is demarcated at the bottom by rigid strippers 5 mounted on a holder 6 under cylinders 1. Each stripper 5 faces a cylinder 1, leaving a slight space 7 between them. The strippers 5 are intended to remove accumulations adhering to cylinders 1.

Cylinders 1 are conventionally hollow. Their outer surfaces consist of rods that constitute a grate. Cylinders 1 accommodate baffles that forward any material that drops into them between the rods out at one end.

Associated with each cylinder 1 is an air-supply channel 8 and an ash hopper 9. The incinerating air travels in the direction indicated by arrows 10 out of channel 8, through ash hopper 9, between the rods, and into the cylinders 1 and out again through the rods at the top. The seal that will now be specified extensively or entirely prevents air from leaking out next to cylinders 1 and through spaces 7.

The seal comprises inherently rigid sealing components 11 that consist of several adjacent sleeve-like sheets. The sheets in each component 11 swing back and forth in bearings 12 mounted on stripper holder 6. Components 11 extend all the way along the surface of cylinders 1 below strippers 5.

Each sheet in each component 11 rests individually on one or more resilient structures against a stripper holder 6. One or more accommodations 13 is secured for this purpose to the side of each sheet in a component 11 that faces away from a cylinder 1. Each accommodation 13 is provided with two pins 14, between which a resilient component, preferably a leaf spring 15, slides back and forth. Leaf springs 15 are secured to and rotate along with a shaft 16. Shaft 16 extends out and is secured in bearings 17. Bearings 17 are secured to stripper holders 6 and to the framework that the grate is secured to. Shaft 16 is engaged by an actuating lever 18.

Above sealing component 11 is a cover 19. Cover 19 is secured to stripper holder 6 and with its lower edge resting against component 11. Cover 19 creates a seal between stripper holder 6 and swinging component 11. Material dropping out of the bed above cylinders 1 and through the space 7 between stripper 5 and cylinder 1 accumulates above component 11 and creates a cushion. The cushion augments the sealing action of components 11 and prevents more material from dropping through.

Shaft 16 is rotated by one or more powerful swings on the part of actuating lever 18, and the resilient components in the form of leaf springs 15 are more or less powerfully tensioned. The result is to vary the force of swinging components 11 against the surface of cylinder 1. If necessary, shaft 16 can be rotated in the opposite sense to raise components 11 off the surface of cylinder 1 even during operation and introduce them into the position A represented by the broken lines. Material accumulating between cylinder 1 and component 11 empties into ash hopper 9.

We claim:

1. A cylinder grate for garbage incinerators comprising: a plurality of hollow grate cylinders positioned spaced from each other and axially parallel along a slanted plane, each pair of said cylinders having a gap therebetween; strippers secured to strip holders below said gap and said cylinders for removing accumulations adhering to said cylinders; means swinging back and forth below said strippers and resiliently forced against an overall length of said cylinders; said means swinging back and forth comprising sealing elements; resilient swinging elements for forcing said sealing elements against said overall length of the cylinder; each said sealing elements comprising a plurality of closely adjacent individual resiliently supported sheets; said resilient swinging elements being leaf springs; an accommodation secured to a side of said sealing elements facing away from said cylinder, each leaf spring rotating along with a shaft and sliding back and forth in said accommodation; cover means between said sealing elements and said strip holders and secured tightly against said strip holders.

2. A cylinder grate for garbage incinerators comprising: a plurality of hollow grate cylinders positioned spaced from each other and axially parallel along a slanted plane, each pair of said cylinders having a gap therebetween; strippers secured to strip holders below said gap and said cylinders for removing accumulations adhering to said cylinders; means swinging back and forth below said strippers and resiliently forced against an overall length of said cylinders; said means swinging back and forth comprising sealing elements; resilient swinging elements for forcing said sealing elements against said overall length of the cylinder; said resilient swinging elements are leaf springs; an accommodation secured to a side of said sealing elements facing away from said cylinder, each leaf spring rotating along with a shaft and sliding back and forth in said accommodation.

3. A cylinder grate as defined in claim 1, wherein each of said sealing elements comprises a plurality of closely adjacent individual resiliently supported sheets.

4. A cylinder grate as defined in claim 2, including cover means between said sealing elements and said strip holders and secured tightly against said strip holders.

* * * * *